US005606226A

United States Patent [19]

Macks et al.

[11] Patent Number: 5,606,226

[45] Date of Patent: Feb. 25, 1997

[54] FILAMENT POWER SUPPLY FOR STATIC VACUUM FLUORESCENT DISPLAY

[75] Inventors: Harold R. Macks, Detroit; Alan E. Sartori, South Lyon, both of Mich.

[73] Assignee: Ford Motor Company, Dearborn, Mich.

[21] Appl. No.: 538,147

[22] Filed: Oct. 2, 1995

[51] Int. Cl.[6] ..... G09G 3/10

[52] U.S. Cl. ..... 315/169.4; 315/337; 315/106; 315/107; 315/169.3

[58] Field of Search ..... 315/104–107, 315/169.1, 169.3, 209 R, 291, 307, 337, 350, 77, 169.4

[56] References Cited

U.S. PATENT DOCUMENTS

| | | | |
|---|---|---|---|
| 2,693,571 | 11/1954 | Higgins, Jr. | 323/19 |
| 2,840,760 | 6/1958 | Torrence | 315/104 |
| 2,936,404 | 5/1960 | Simone | 315/130 |
| 3,588,672 | 6/1971 | Wilson | 323/4 |
| 3,903,454 | 9/1975 | Matsui et al. | 315/307 |
| 4,107,580 | 8/1978 | Thackray | 315/311 |
| 4,158,794 | 6/1979 | Sandler | 315/169.1 |
| 4,209,729 | 6/1980 | McElroy | 315/169.1 |
| 4,237,405 | 12/1980 | Kellis | 315/307 |
| 4,241,278 | 12/1980 | Walther | 315/106 |
| 4,488,089 | 12/1984 | Shota | 315/106 |
| 4,495,445 | 1/1985 | Turney | 315/169.1 |
| 4,504,776 | 3/1985 | Haville | 323/288 |
| 4,968,917 | 11/1990 | Harris | 315/77 |
| 4,970,441 | 11/1990 | Lippmann et al. | 315/337 |
| 4,972,122 | 11/1990 | Daidouji et al. | 315/106 |
| 4,999,543 | 3/1991 | Sano et al. | 315/169.3 |
| 5,013,971 | 5/1991 | de La Chapelle | 315/149 |
| 5,185,559 | 2/1993 | Shimoda et al. | 315/107 |
| 5,402,042 | 3/1995 | Madsen | 315/174 |
| 5,469,026 | 11/1995 | Madsen | 315/169.4 |

OTHER PUBLICATIONS

SAE 940258, entitled "Universal Grid Vacuum Fluorescent Display For Automotive Applications", by S. Shinya et al; dated Feb. 28–Mar. 3, 1994.

SAE 940514, entitled "High Luminance Graphic Vacuum Fluorescent Display For Automotive Applications", by T. Minato et al; dated Feb. 28–Mar. 3, 1994.

*Primary Examiner*—Robert Pascal
*Assistant Examiner*—Haissa Philogene
*Attorney, Agent, or Firm*—Paul K. Godwin

[57] ABSTRACT

A DC power supply 44 for providing a desired filament voltage to a static filament in a vacuum fluorescent display 16 includes a voltage regulator 46 with an input and an output. The input couples to a source of ignition voltage 10 while the output couples to the base of a transistor 50. A first dropping resistor 52 connects between the source of ignition voltage 10 and the collector of the transistor 50. A second dropping resistor 54 connects between the emitter of the transistor 50 and the filament 20 of the VF display 16. Accordingly, a first current path to the filament 20 is defined through the first dropping resistor 52, the collector-emitter junction of the transistor 50, and the second dropping resistor 54. A second current path to the filament 20 is defined through the voltage regulator 46, the base-emitter junction of the transistor 50, and the second dropping resistor 54. In operation, therefore, filament current flows through the first current path when the source of ignition voltage 10 is operating in an upper portion of its range dissipating a significant amount of power across the first dropping resistor 52. Alternatively, filament current flows through the second current path when the source of ignition voltage 10 is operating in a lower portion of its voltage fluctuation range.

10 Claims, 1 Drawing Sheet

FILAMENT POWER SUPPLY FOR STATIC VACUUM FLUORESCENT DISPLAY

BACKGROUND OF THE INVENTION

1. Technical Field

This invention relates generally to vacuum fluorescent displays and more particularly to a power supply for providing DC filament voltage to a static vacuum fluorescent display.

2. Discussion of the Prior Art

Vacuum fluorescent (VF) displays are generally defined by an evacuated tube enclosing one or more phosphor-coated anodes arranged in a predetermined pattern for emitting light, a filament and a grid disposed Is between the anodes and filament. The filament is electrically heated at a relatively low voltage to generate a cloud of electrons. In small VF displays (approximately fifty segments or less) a DC filament voltage of 2 to 3 volts can be used. In contrast, the grid is maintained at a relatively high voltage to accelerate electrons onto any of the anodes which are also maintained at a relatively high voltage. The phosphor-coated anodes emit light when excited by the accelerated electrons.

A typical VF display system for use in an automobile is shown in the prior art drawing of FIG. 1. Referring to FIG. 1, conventional battery 10 is connected by ignition switch 12 to terminal 14 which, when referenced to the vehicle ground, is generally referred to as ignition voltage IGN. VF display 16 comprises a plurality of anode segments 18, filament 20, and grid 22 disposed therebetween. Each anode segment 18 may be selectively connected to ignition voltage IGN through display driver 24 which typically is coupled to a microprocessor (not shown) for controlling which segments to light. Anode segments 18 are arranged in a predetermined pattern to create symbols, numerals, characters, etc. For example, to display time in a clock, or current temperature in a climate control panel.

To protect against excess ignition voltage IGN fluctuations, voltage limiting circuitry 26 is typically interposed between the ignition voltage input terminal 14 and both display driver 24 and grid 22. A blocking diode 28 may also be included to protect against a reverse battery condition. Accordingly, power to grid 22 and anode segments 18 are referenced to a relatively high voltage close to ignition voltage IGN. In contrast, filament 20 is energized to a relatively low potential by initially stepping down ignition voltage IGN to a regulated 5 volts through resistor 30 and voltage regulator 32. Finally, the nominal filament voltage $V_f$, typically 2 to 3 volts in automotive applications, is provided by further stepping the regulated voltage down through resistor 34.

The inventors herein have recognized several problems and disadvantages of the prior art approach discussed above. Particularly, the above approach requires the expense of a dedicated integrated circuit; voltage regulator 32 in this case. Moreover, the circuit must be designed to stay in regulation and to adequately dissipate power over the range of ignition voltage which typically fluctuates between 8 and 18 volts. Resistors 30 and 34, while helpful in regards to establishing the proper filament voltage, provide minimal assistance in dissipating power because of the necessity of keeping voltage regulator 32 in regulation over the entire range of ignition voltage IGN. Moreover, large heat sinks may be necessary to remove heat from voltage regulator 32 because of the limited amount of power which may be dissipated over resistor 30.

In some applications, it may be desirable to use voltage regulator 32 to power other circuitry in the display module in addition to providing power to the filament. However, a likely consequence of sharing regulator 32 is that it will be subjected to noise generated by the filament which may be difficult to suppress. Accordingly, a second voltage regulator 36 is typically included to support the other 5 volt requirements.

An alternative to the dedicated voltage regulator 32 shown in FIG. 1 is a pass transistor in combination with an operational amplifier. Like the approach of FIG. 1, however, this system would similarly require a dedicated integrated circuit designed to operate within regulation to accommodate the full range of ignition voltage fluctuation. Accordingly, there is a need for a low cost filament power supply with improved power dissipation.

SUMMARY OF THE INVENTION

It is therefore an object of the present invention to provide distributed power dissipation while stepping down the ignition voltage to a nominal filament voltage. It is a further object to eliminate the need for a dedicated monolithic device to provide the regulated filament voltage.

The above objects are achieved, and problems of prior art approaches overcome, by providing a DC filament power supply for a vacuum fluorescent display having a filament with one end connected to ground and the other end connected to the power supply. In one aspect of the invention, the DC power supply for providing a desired filament voltage from a source of ignition voltage having a range of voltage fluctuation comprises: first power dissipation means coupled to the source of ignition voltage for providing the desired filament voltage during an upper portion in the range of voltage fluctuation of the source of ignition voltage; and second power dissipation means coupled to the source of ignition voltage for providing the desired filament voltage during a lower portion in the range of voltage fluctuation of the source of ignition voltage In a preferred embodiment, the first power dissipation means includes an emitter-follower and a dropping resistor coupled thereto. The second power dissipation means preferably includes a voltage regulator that couples to the base of said emitter-follower.

An advantage of the above aspect of the invention is that power dissipation is distributed over several elements. Another advantage is that a dedicated integrated circuit is not required.

BRIEF DESCRIPTION OF THE DRAWINGS

The above objects and advantages of the present invention will be more clearly understood by reading an example of a preferred embodiment in which the invention is used to advantage with reference to the attached drawings wherein like numerals refer to like parts and wherein.

DETAILED DESCRIPTION OF AN EMBODIMENT

Figure 1:
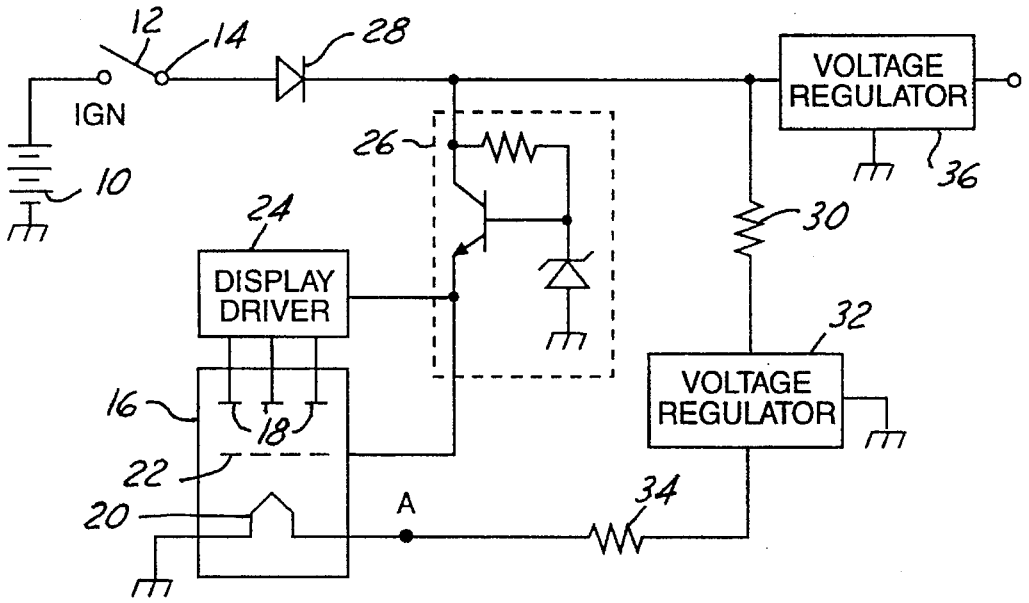
(PRIOR ART) FIG.1
FIG. 1 is a schematic representation of a system embodying a prior art power supply.
Figure 2:
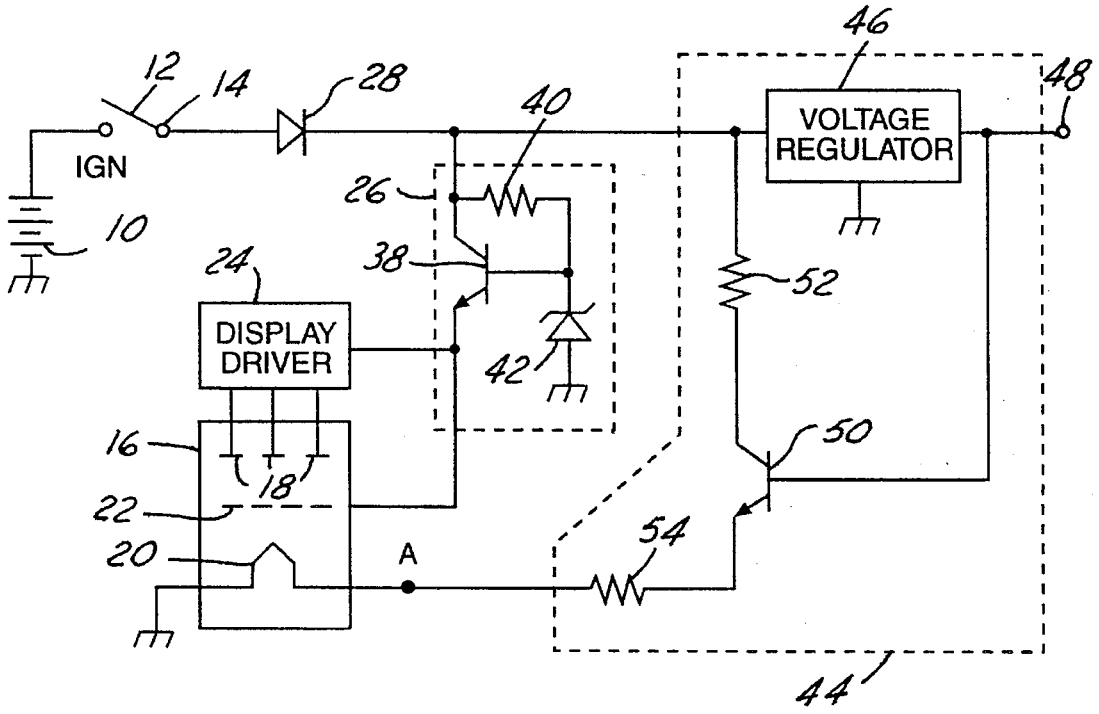
FIG. 2 is a schematic representation of a system in which an embodiment of the invention is used to advantage.

Referring now to FIG. 2, a system in which an embodiment of the present invention is used to advantage is shown. Similar to the prior art system of FIG. 1, battery 10 is connected to ignition switch 12 which supplies ignition voltage IGN to input terminal 14. As shown, VF display 16 includes a plurality of anode segments 18, a filament 20 and a grid 22 interposed therebetween. While only three anode segments 18 are shown in the current embodiment, more segments may be added to provide the desired illumination pattern. For a small display with a single filament 20 operating in the static mode, the number of anode segments 18 may reach as high as fifty or more segments. As with the prior system in FIG. 1, display driver 24 is included to control anode segments 18 in a conventional manner. In the present example, display driver 24 is a TL5812 display driver manufactured by Texas Instruments Incorporated. As shown in FIG. 2, display driver 24 and grid 22 are coupled to the output of voltage limiting circuitry 26. In the present embodiment voltage limiting circuitry 26 includes NPN transistor 38 which is biased as an emitter-follower by resistor 40. In such a configuration, the emitter voltage follows the voltage applied at the base minus the base-emitter junction voltage $V_{BE}$. In this example the base voltage is limited to 14 volts by zener diode 42. Finally, as shown in FIG. 1, blocking diode 28 is interposed between voltage regulating circuitry 26 and input terminal 14 to protect against a reverse battery condition.

Diverting from the prior art system of FIG. 1, DC filament power supply 44 will now be described with continuing reference to FIG. 2. As shown, power supply 44 includes voltage regulator 46. In this case, voltage regulator 46 is a monolithic 5 volt regulator such as the CS8126 regulator manufactured by Cherry Semiconductor Corporation. Ignition voltage IGN provides power to voltage regulator 46. Preferably, the output of voltage regulator 46 also connects to terminal 48 which can be used to provide 5 volt power to other monolithic devices. The output of voltage regulator 46 also couples to the base of NPN transistor 50.

Dropping resistor 52 connects between the input of voltage regulator 46 and the collector of transistor 50. Another dropping resistor 54 connects at one end to the emitter of transistor 50 and at the other end to filament 20 at defined node A. In essence, node A represents the output of power supply 44 at which the desired filament voltage is provided to filament 20.

Continuing with FIG. 2, the operation of power supply 44 will now described In an automobile, the various electrical loads on battery 10 significantly change during operation. The continuous draining and charging of battery 10 typically result in battery fluctuations ranging between 8 to 18 volts. Accordingly, ignition voltage IGN similarly fluctuates. To maintain uniform intensity in VF display 16 however, it is important to minimize these fluctuations when stepping ignition voltage IGN down to the filament voltage desire for heating filament 20.

In the typical automotive application that uses a small VF display, such as for clocks and climate control displays, the required filament voltage is typically 2 to 3 volts depending on the display specifications. A problem with providing a constant filament voltage at node A, however, is that filament 20 does not have a fixed resistance. Rather, the resistance varies with applied voltage. Increasing the voltage on filament 20 increases the current through it which results in heat. At higher temperatures, filament 20 has a higher resistance thus tending to limit further increases in current. Conversely, decreasing applied voltage on filament 20 allows it to cool to a lower resistance which helps reduce the decrease in current that would have taken place bad the resistance not changed. Obviously, the exact current drawn through filament 20 depends on its temperature. The typical range however is ±5% of the nominal current draw (250 milliamps in the present example). Accordingly, it is desirable that power supply 44 account for the filament characteristics so that the voltage provided at node A is at the desired filament voltage level, 25 volts in the present example.

Another critical design consideration, is the dissipation of power in power supply 44 when stepping down ignition voltage IGN to the desired filament voltage $V_f$. In prior art systems such as that shown in FIG. 1, a single current path was provided for stepping down ignition voltage IGN to filament voltage, $V_f$. As shown in FIG. 2, power supply 44 provides two filament current paths which operate independently depending upon the level of ignition voltage IGN. The first current path is provided from terminal 14 through blocking diode 28 and dropping resistor 52, across the collector-emitter junction of transistor 50, through dropping resistor 54 to filament; 20. An alternative current path is provided from terminal 14 through blocking diode 28, voltage regulator 46, the base-emitter junction of transistor 50 and dropping resistor 54 to filament 20.

In the present embodiment, voltage regulator 46 continuously biases the base of transistor 50 to 5 volts. Resistor 52 is sized to drop approximately 5 volts between the input of voltage regulator 46 and the collector of transistor 50. Accordingly, when ignition voltage IGN is within the range of 11 to 18 volts, transistor 50 operates in the active region as an emitter-follower. The voltage at the collector of transistor 50, therefore, is always greater than the voltage at the base $V_B$ of transistor 50. Dropping resistor 54 is appropriately sized to drop the emitter voltage $V_E$ to the desired filament voltage at node A given the nominal current draw through filament 20.

Alternatively, when ignition voltage IGN is less than 11 volts such that the resultant voltage at the collector of transistor 50 does not allow transistor 50 to become active, current will flow through the alternative path. In this case, the nominal filament current of 250 milliamps is drawn from voltage regulator 46. Because the base of transistor 50 is regulated to 5 volts, the emitter voltage $V_E$ of transistor 50 equals the base voltage $V_B$ minus the voltage drop across the base-emitter junction $V_{BE}$. Dropping resistor 54 as before then drops the emitter voltage $V_E$ to the desired filament voltage at node A.

An advantage of the two independent current paths is that a significant amount of power in stepping down ignition voltage IGN is dissipated across resistor 52 when the ignition voltage IGN is in the upper portion of its range of fluctuation (i.e., above 11 volts in this example). An advantage of dissipating a significant amount of power across resistor 52 is that a lower power, less expensive transistor can be used for transistor 50.

In contrast, when ignition voltage IGN is operating in the lower portion of its range, the majority of power is dissipated in voltage regulator 46. An advantage of restricting the use of voltage regulator 46 for filament current to the low end of the ignition voltage range is that the power dissipation requirements of the regulator are reduced and less expensive heat sinks may be used. For example, voltage regulator 32 in FIG. 1 will typically require at least a 6 volt input to provide a regulated 5 volt output. Accordingly, if the system is to be designed to operate even when ignition voltage IGN drops to 8 volts, resistor 30 can be sized to drop a maximum of approximately 1.3 volts. In this circumstance, power dissipation across voltage regulator 42 is not an issue. However, should ignition voltage IGN reach 18 volts, resistor 30 will still only provide a maximum drop of 1.3 volts.

Accordingly, voltage regulator 32 is likely to require a larger, costlier heat sink to effectively remove the heat generated in the device while stepping its input voltage of 16 volts down to the regulated 5 volt output.

Another advantage to power supply 44 of the present invention is that a dedicated voltage regulator is not required. For example, in the system of FIG. 1, voltage regulator 32 provides power to filament 20 while voltage regulator 36 provides 5 volt power to any additional circuitry. In the embodiment shown in FIG. 2, voltage regulator 46 can be utilized for both purposes since the base-emitter junction of transistor 50 buffers the output from any noise which may be generated by filament 20.

One skilled in the art may also recognize yet another advantage provided by transistor 50 in the presently described system. Specifically, as described above, resistance of filament 20 will increase and current through filament 20 will decrease as filament 20 is heated. The relationship between the resistance and current, however, is not linear. Rather, the applied voltage present at node A has a tendency to rise slightly. In contrast, the voltage drop $V_{BE}$ across the base-emitter junction of transistor 50 has an inverse temperature relationship. In other words, as temperature rises in transistor 50, the voltage drop $V_{BE}$ across the base-emitter junction decreases. The present invention utilizes the inherent characteristics of the base-emitter voltage drop to compensate for the characteristics of filament 20. In other words, the changing base-emitter voltage drop of transistor 50 and variations in temperature allow filament 20 to self-regulate. As a result, the voltage applied to filament 20 at node A remains virtually constant despite temperature fluctuations.

This concludes a description of the preferred embodiment. The reading of it by those skilled in the art will bring to mind many alterations and modifications beyond those already suggested above without departing from the spirit and scope of the invention. For example, while voltage regulator 46 in the present embodiment is an integrated circuit, one skilled in the art will recognize that other voltage regulation circuits could be similarly employed. Additionally, while grid 22 and anode segments 18 are tied to ignition voltage IGN, one skilled in the art will certainly recognize that the actual voltage potentials provided to anode segments 18 and grid 22 do not necessarily need to be maintained at the same level. Moreover, known circuitry may be added between the grid and the input terminal 14 to provide a display dimming feature. Accordingly, it is intended that the scope of the invention be limited to only the following claims.

What is claimed:

1. In a vacuum fluorescent display having a filament that includes one end for connection to ground and the other end for connection to a DC power supply, a DC power supply for providing a desired filament voltage from a source of ignition voltage having a range of voltage fluctuation comprising:

first power dissipation means coupled to the source of ignition voltage for providing the desired filament voltage during an upper portion in the range of voltage fluctuation of the source of ignition voltage; and second power dissipation means coupled to the source of ignition voltage for providing the desired filament voltage during a lower portion in the range of voltage fluctuation of the source of ignition voltage.

2. A DC power supply for providing filament voltage according to claim 1 wherein said first power dissipation means includes an emitter-follower.

3. A DC power supply for providing filament voltage according to claim 2 wherein said first power dissipation means further includes a dropping resistor coupled to said emitter-follower.

4. A DC power supply for providing filament voltage according to claim 2 wherein said second power dissipation means includes a voltage regulator.

5. A DC power supply for providing filament voltage according to claim 4 wherein an output of said voltage regulator couples to the base of said emitter-follower.

6. A DC power supply for providing a desired filament voltage to a static filament in a vacuum fluorescent display comprising:

a voltage regulator having an input and an output, said input coupled to a source of ignition voltage;

a transistor having a base, a collector and an emitter; said base coupled to said output of said voltage regulator;

a first dropping resistor connecting at one end to said source of ignition voltage and at the other end to said collector of said transistor;

a second dropping resistor connecting at one end to said emitter of said transistor and at the other end to the filament.

7. A DC filament power supply for providing a desired filament voltage according to claim 6 wherein said source of ignition voltage provides said ignition voltage within a range of voltage fluctuation, and said first dropping resistor dissipates a significant amount of power when said source of ignition voltage is operating in an upper portion of said range of voltage fluctuation.

8. A DC filament power supply for providing a desired filament voltage according to claim 6 wherein a first current path to the filament is defined through said first dropping resistor, the collector-emitter junction of said transistor, and said second dropping resistor;

a second current path to the filament is defined through said voltage regulator, the base-emitter junction of said transistor, and said second dropping resistor;

filament current flows through said first current path when said source of ignition voltage is operating in an upper portion of said range of voltage fluctuation; and filament current flows through said second current path when said source of ignition voltage is operating in a lower portion of said range of voltage fluctuation.

9. A DC filament power supply for providing a desired filament voltage according to claim 8 wherein said voltage regulator biases said base of said transistor when said source of ignition voltage is operating in an upper portion of said range of voltage fluctuation.

10. A filament power supply for a static vacuum fluorescent display device containing an electrically energizable filament connected between the filament power supply and ground for use in an automotive vehicle containing a vehicle power supply that generates DC voltage with the potential for wide variations in voltage fluctuations comprising:

a transistor having an emitter, a base and a collector;

a first voltage dropping resistor connected between the emitter of said transistor and said filament;

a second voltage dropping resistor connected between the collector of said transistor and said vehicle power supply;

a voltage regulator circuit connected to said vehicle power supply for regulating the voltage provided by said vehicle power supply to a predetermined first voltage level when the voltage output from said vehicle power supply is above said first voltage level and providing said first voltage level as a voltage regulator output;

said voltage regulator output being provided to the base of said transistor to cause said transistor to act as an emitter follower as long as said output is maintained at said predetermined first voltage level, wherein the current supplied to said filament is caused to flow from the vehicle power supply through a first conducting path comprising said second resistor, the collector to emitter path of said transistor and said first resistor; and said voltage regulator causing said transistor to act as diode whenever said output drops below said first predetermined voltage level, wherein said current supplied to said filament is caused to flow from the vehicle power supply through a second conducting path comprising the voltage regulator output, the base to emitter path of said transistor and said first resistor.

* * * * *